United States Patent [19]

Collins et al.

[11] Patent Number: 4,645,469

[45] Date of Patent: Feb. 24, 1987

[54] BEAM SHAPING CRT ELECTRODE AND METHOD OF FABRICATING SAME

[75] Inventors: Floyd K. Collins, Seneca Falls; Donald L. Say, Waterloo, both of N.Y.

[73] Assignee: North American Philips Consumer Electronics Corp., New York, N.Y.

[21] Appl. No.: 403,839

[22] Filed: Jul. 30, 1982

Related U.S. Application Data

[62] Division of Ser. No. 175,165, Aug. 4, 1980, abandoned.

[51] Int. Cl.[4] ..... H01J 9/14

[52] U.S. Cl. ..... 445/49

[58] Field of Search ..... 445/49, 35; 313/407

[56] References Cited

U.S. PATENT DOCUMENTS 2,888,588 5/1959 Dichter ..... 313/448

3,767,953 10/1973 Bossers ..... 313/447

4,307,498 12/1981 Say ..... 445/49

4,366,414 12/1982 Hatayama et al. ..... 445/47

FOREIGN PATENT DOCUMENTS 117677 9/1979 Japan ..... 313/447

21832 2/1980 Japan ..... 445/49

*Primary Examiner*—Kenneth J. Ramsey

*Attorney, Agent, or Firm*—John C. Fox

[57] ABSTRACT

A CRT electron gun electrode is provided with an improved beam shaping region having an elongated recess coined in the upper electrode surface and an opposed coined depression in the lower surface. The double coining fabrication method assures a sharp perimetrical edge about at least the central portion of the recess, such being an important influence in achieving improved beam shaping lensing.

3 Claims, 6 Drawing Figures

BEAM SHAPING CRT ELECTRODE AND METHOD OF FABRICATING SAME

This is a division of application Ser. No. 175,165, filed Aug. 4, 1980, abandoned.

TECHNICAL FIELD

This invention relates to electron guns for cathode ray tubes and more particularly to beam shaping electrodes and to a method for fabricating such electrodes.

BACKGROUND OF THE INVENTION

Generally speaking, the use of beam shaping electrodes in CRT electron guns to beneficially modify the lensing of the beams is known in the art. Discrete beam shapings minimize deflected spot distortion, such being especially true when self converging yokes are employed with in-line gun tubes. Electrodes with beam shaping properties provide a lensing field of equipotential lines of force to form the bundle of moving electrons into a beam of desired cross-sectional shaping. Exemplary art is evidenced in U.S. Pat. Nos. 3,852,608, 3,866,081 and 4,143,293. Such prior art techniques are complicated and expensive to fabricate, and require either a multiple part electrode or cooperation between two or more electrodes.

Some beam shaping electrodes have been manufactured as two-piece structures in an effort to achieve the desired beam forming characteristics. For example, the prior art discloses beam shaping electrodes constructed of two superimposed rectangularly slotted elements affixed in orthogonal relationship to provide a substantially square aperture therethrough. In fabrication, it is difficult to keep proper alignment between the two slots, and the affixural welding can produce surface imperfections which are deleterious to the forming of the desired beam shaping lensing.

Attention is also directed to three previously and concurrently filed patent applications which are assigned to the assignee of the present invention. These applications are Ser. Nos. 94,405 now U.S. Pat. No. 4,307,498, issued Dec. 29, 1981, 94,409 now U.S. Pat. No. 4,272,700, issued June 9, 1981, and 94,515 now U.S. Pat. No. 4,251,747, issued Feb. 17, 1981, all of which were filed Nov. 15, 1979. The respective disclosures in these applications relate to the field of the present invention, but differ markedly therefrom.

DISCLOSURE OF THE INVENTION

It is therefore an object of this invention to reduce and obviate the aforementioned disadvantages evidenced in the prior art, and to differentiate from the afore-noted pending patent applications. Another object of the invention is to provide a one-piece beam shaping CRT electron gun electrode that evidences improved beam forming properties. A further object of the invention is to provide a method for facilely fabricating the improved configurated beam shaping region in such an electrode.

These and other objects and advantages are accomplished in one aspect of the invention by the provision of an CRT electrode having an improved configurated beam-shaping region formed in the effectual portion of the electrode member. This discretely formed region is comprised of an elongated recess pressed or coined into the upper surface of the effectual portion, and an oppositely oriented depression pressed or coined into the lower surface thereof. The residual electrode material, intermediate the bottoms of the recess and the depression, has a symmetrically located aperture formed therethrough. The electrode fabrication procedure utilizing the aforementioned opposed coinings flows the electrode material in a manner to assure the formation of a beneficially sharp perimetrical edge at least partially about the upper surface related recess. This sharp edge perimeter, in the region of the aperture, markedly augments the beam-shaping properties of the configuration thereby promoting an improved lensing effect which beneficially modifies the cross-sectional shaping of the beam in the desired manner.

BEST MODE FOR CARRYING OUT THE INVENTION

For a better understanding of the present invention together with other and further objects, advantages and capabilities thereof, reference is made to the following disclosure and appended claims taken in conjunction with the aforedescribed drawings.

For purposes of illustration, a color cathode ray tube employing an apertured mask and an in-line plural gun electron generating assembly will be initially described in this specification as an exemplary setting for the invention. It is understood that such is not to be considered limiting to the concept of the invention.

Figure 1:
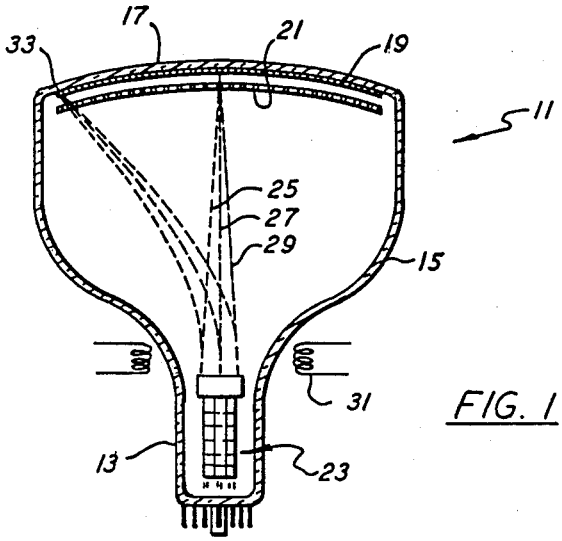
FIG. 1 is a cross-sectional view of a cathode ray tube wherein the invention is utilized.

With particular reference to FIG. 1, the essentials of a plural in-line beam color cathode ray tube construction 11 are shown. The encompassing envelope is comprised of an integration of neck 13, funnel 15 and face panel 17 portions. A patterned cathodoluminescent screen 19 of color-emitting phosphor areas is disposed on the interior surface of the viewing panel 17 as an array of definitive stripes or dots, in keeping with the state of the art. A multiple apertured structure 21, in this instance a shadowmask, is spatially related to the patterned screen; such being located within the panel by conventional means, not shown.

Positioned within the neck portion 13 of the envelope is an electron gun assembly 23 comprised of several related electron guns, each of which produces a respective electron beam 25, 27 and 29. While not shown, each of these individual guns includes a cathode and a pluraltiy of sequentially arranged cooperating electrode elements which are formed and spaced to provide the source, formation, acceleration and focusing of the respective electron beam in a manner to properly impinge the screen 19.

Positioned externally of the tube 11 is a deflection yoke 31 which deflects the beams in a determined manner to provide an image display raster upon the screen. With the acceptance in the art of self-converging deflection yokes, a need has arisen for improved edge-of-screen focus 33. Thus, an improvement in the beam forming region of each electron gun is of important significance.

Figure 2:
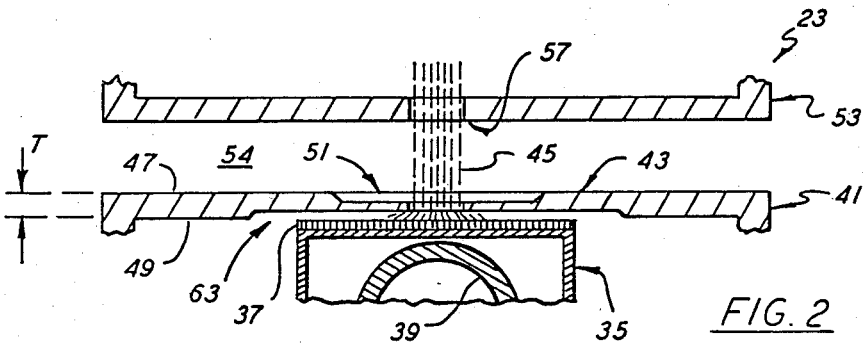
FIG. 2 is an enlarged sectional view of a portion of an electron gun showing the initial beam shaping region thereof.
Figure 3:
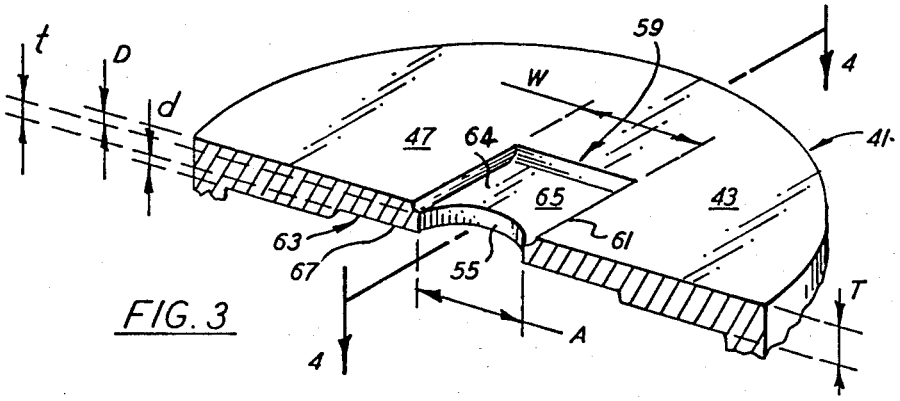
FIG. 3 is a sectional perspective view of the improved beam shaping electrode.
Figure 4:
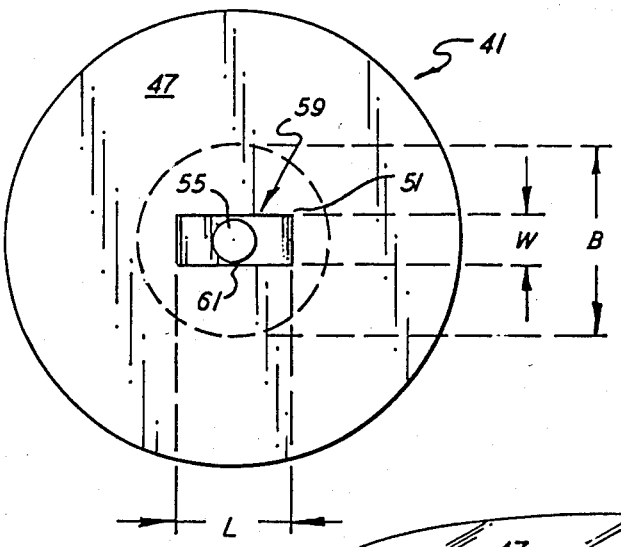
FIG. 4 is a plan view of the same taken along the line 4—4 of FIG. 3.

In referring to FIGS. 2, 3 and 4, there is shown an exemplary enlarged sectional view of the rear beam forming region of one of the elctron guns of the gun assembly 23. This shown portion of the gun structure includes a thermionic cathode structure 35 having external electron emissive material 37 terminally disposed thereon, such being activated by an internally positioned heating element 39. Positioned adjacent thereto is a first or control grid electrode (G1) 41 having a one-piece effectual portion 43 transversely oriented to the path of the beam bundle of electrons 45. This effectual portion evidences an upper surface 47 and a lower surface 49, such defining a material thickness "T" therebetween. The shown effectual portion 43 of the control electrode 41 may be an element of several electrode constructions. For example, it can be the bottom part of an individual cup-shaped (G1) member, or a substantially planar dish-shaped portion of an integrated (G1) assembly utilizing a common grid plane for a plurality of guns. The invention relates to the improved beam shaping region regardless of the over-all construction of the electrode.

Formed in the electrode effectual portion 41 of the control electrode is the improved beam shaping region 51, which in conjunction with the spatially related apertured second or screen grid electrode (G2) 53 in an operating gun, provides an initial beam lensing influence in the inter-electrode spacing 54 therebetween. The contoured configuration of the (G1) beam shaping region 51, adjacent the aperture 55 therethrough, and the related apertured effectual portion 57 of the second (G2) electrode, together influence shaping of the array of equipotential lines of force constituting the lensing in a manner to beneficially modify the shaping of the beam bundle of electrons 45 passing therethrough.

In greater detail, the improved configurated beam shaping region in the control electrode 41 has an elongated recess 59 formed, as by coining, inward from the upper surface 47 thereof. The term "coining" as used herein refers to the deformation of material by applied pressure, whether or not the deformed material is contained in a die cavity. This recess, which is free of surface imperfections, has a defined width "W", length "L" and depth "D", and as exemplarily shown, is substantially rectangular in shape. There may be occasions when the desired lensing effects may require a more ovate modified shaping. It is an important lens forming consideration that this recess evidences a substantially sharp perimetrical edge 61 at least partially thereabout. This is usually difficult to achieve in a stamping or coining operation per se since such pressure techniques tend to form a slightly rolled or radiused edge.

To achieve the desired sharp edge 61 about at least the central region of the recess 59, a depression 63 is formed, as by coining, inward from the lower surface 49 of the control electrode 41 in opposed orientation to the upper surface-related recess 59. These upper and lower related coining operations produce a beneficial flow of electrode material. This lower surface depression is exemplarily shown as being circular in shape, but it too, may be of a modified ovate shaping. Its diameter or longest lateral dimension "B" should be sufficient to provide a flow of material to at least the central perimetrical region of the related recess 59. The residual electrode material 64 intermediate the bottom 65 of the recess and the bottom 67 of the depression evidences a thickness "t". In one example of structural relationships, the depth "D" of the recess 59 does not exceed the thickness "t" of the residual material, and the depth "d" of the depression 63 is less than the thickness "t" of the residual material. As shown in FIG. 2, the depression 63 is dimensioned to accommodate positioning of the cathode 35 in close spatial relationship with the bottom surface of the control (G1) electrode. Such accommodation tends to effect a degree of shielding for the emissive surface of the cathode.

An aperture 55 is formed through the residual material 64 in symmetrical relationship with the recess 59 and the depression 63 to complete the improved configurated beam shaping region 51. This aperture is exemplarily shown as being circular in shaping, but such is not to be considered limiting. Regardless of its shaping, its width or diametrical dimension "A", is slightly less than the width dimension "W" of the recess. Such dimensional relationship, as shown in FIGS. 3 and 4, allows a clean aperture to be formed through the residual material 64 without damaging the sharp perimetrical edge 61 of the recess or scarring the sidewalls thereof.

Figure 5:
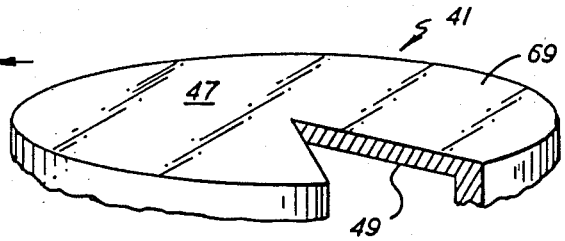
FIG. 5 is a sectional view of the electrode blank prior to imparting beam shaping properties thereto.
Figure 6:
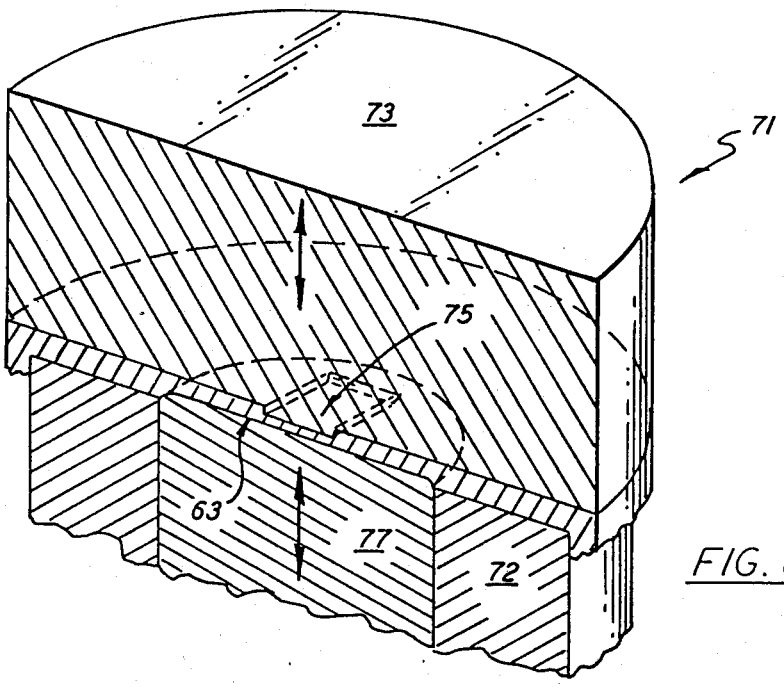
FIG. 6 is a sectional perspective view illustrating fabrication of the electrode.

Regarding fabrication of the beam shaping configuration of the electrode, reference is directed to FIG. 5 wherein there is shown a grid blank for the control (G1) electrode 41. The effectual portion is defined by the perimeter 69, in this instance circular, with the upper surface 47 and the lower surface 49 thereof defining a given thickness therebetween. This blank is positioned in a tooling arrangement 71 as shown in FIG. 6. With the blank resting on a bottom anvil member, 72 a top forming die 73, having a defined projection 75, is pressured against an appropriate part of the upper surface of the electrode blank 41 in a manner to coin the substantially rectangular recess 59 therein. Preferably simultaneously, a movable coining die 77, contained for sliding operation within anvil member 72, is pressured against the lower surface 49 of the blank to coin the substantially circular depression 63 in the lower surface thereof. The resultant flow of material effected by the coining of the depression, forces some of the flow material to the top forming die to fill in the inherently round edge about the recess 59, thereby promoting the formation of the substantially sharp perimetrical edge 61 about at least the central portion thereof. This is an important fabrication consideration, since the sharp edge of the recess, particularly in the region of the aperture, subsequently effects a beneficial improvement in the beam shaping lensing.

The beam aperture 55 is thence provided in the coined region, being oriented as heretofore described. Thus, the forming of the configurated beam shaping region is completed.

Utilization of the aforedescribed double-coining fabrication procedure and the resultant improved electrode structure formed thereby obviate many of the disadvantages evidenced in the prior art.

INDUSTRIAL APPLICABILITY

The CRT electron gun electrode structure of the invention incorporates a discretely configurated beam shaping region which contributes to improved lensing influencing the initial shaping of the beam. The economical and expeditious double coined fabrication procedure assures the achievement of the beneficially sharp perimetrical edge in at least the critical region of the recess portion of the configuration. The one-piece electrode structure reduces manufacturing costs, and overcomes further disadvantages of the two-piece structures of the prior art by eliminating the inaccuracies of multiple-piece assembly and the possible presence of weld burrs on critical surfaces.

We claim:

1. A method for fabricating a configurated beam shaping region in a CRT electron gun electrode member having a one-piece effectual portion evidencing upper and lower surfaces defining an elongated recess in the upper surface, the recess having substantially sharp perimetrical edges in at least its central region, and a shallow depression in the lower surface, and a material thickness therebetween, said method comprising the steps of: coining an elongated recess inward from said upward surface; substantially simultaneously coining a substantially shallow depression of substantially circular or ovate shape inward from said lower surface in opposed orientation to said recess coining to expedite a flow of electrode material to the upper coining region thereby promoting the formation of substantially sharp perimetrical edges in at least the central region of said recess; and forming an aperture through the residual electrode material intermediate the bottoms of said coined recess and said coined depression to complete said beam shaping configuration.

2. The method according to claim 1 wherein said coined recess is of substantially rectangular shaping.

3. The method according to claim 1 wherein the depth of said coined recess does not exceed half the thickness of said electrode material.

* * * * *